US005125114A

United States Patent [19]

Grilliot et al.

[11] Patent Number: 5,125,114

[45] Date of Patent: Jun. 30, 1992

[54] FIREFIGHTER'S COAT HAVING WATERGUARD CUFF

[76] Inventors: William L. Grilliot; Mary I. Grilliot, both of 1986 Home Ave., Dayton, Ohio 45417

[21] Appl. No.: 657,144

[22] Filed: Feb. 19, 1991

[51] Int. Cl.[5] ..... A41B 7/06

[52] U.S. Cl. ..... 2/124; 2/161 R; 2/162

[58] Field of Search ..... 2/16, 59, 60, 123, 124, 2/125, 126, 160, 161 R, 162, 170, DIG. 6, 82, 87

[56] References Cited

U.S. PATENT DOCUMENTS

| | | | |
|---|---|---|---|
| 375,958 | 1/1888 | Skeffington | 2/59 |
| 1,192,042 | 7/1916 | Cross | 2/162 |
| 1,315,421 | 9/1919 | Ross | 2/162 |
| 1,349,987 | 8/1920 | Strumph | 2/124 |
| 1,911,209 | 5/1933 | Russo | 2/124 |
| 1,934,332 | 11/1933 | Skinner | 2/162 |
| 2,382,907 | 8/1945 | Persin | 2/124 |
| 2,394,136 | 2/1946 | Bakke | 2/161 R |
| 2,448,697 | 9/1948 | Bakke | 2/161 R |
| 3,555,568 | 1/1971 | Humphrey | 2/124 |
| 3,889,297 | 6/1975 | Jarboe | 2/123 |
| 4,388,733 | 6/1983 | Anstett | 2/162 |

FOREIGN PATENT DOCUMENTS

| | | | |
|---|---|---|---|
| 139225 | 10/1934 | Fed. Rep. of Germany | 2/162 |
| 2291714 | 6/1976 | France | 2/160 |
| 1568015 | 5/1980 | United Kingdom | 2/125 |

*Primary Examiner*—Werner H. Schroeder
*Assistant Examiner*—Diana L. Biefeld
*Attorney, Agent, or Firm*—Jacox & Meckstroth

[57] ABSTRACT

Protective shield structure for the sleeve of a firefighter's coat. The protective shield structure is in the form of a curved member which is attached to the end portion of the sleeve of the firefighter's coat. The protective shield structure is positioned above a part of a glove worn by the firefighter adjacent the end of the sleeve of the firefighter's coat. The protective shield structure thus prevents the entry of water and other material into the glove as the firefighter is engaged in firefighting activity.

8 Claims, 2 Drawing Sheets

FIREFIGHTER'S COAT HAVING WATERGUARD CUFF

BACKGROUND OF THE INVENTION

A firefighter's protective gear conventionally includes a firefighter's coat or jacket and a pair of firefighter's gloves. The firefighter's gloves cover the firefighter's hands and are positioned adjacent the ends of the sleeves of the firefighter's coat or jacket. The firefighter's gloves must be readily removable. Therefore, conventionally, the gloves do not extend over the sleeves of the firefighter's coat. Also, due to the fact that the gloves must be readily removable, the firefighter's gloves are not attached to the ends of the sleeves of the firefighter's coat.

As the firefighter is active in firefighting, gaps or spaces occur between the ends of the sleeves of the firefighter's coat and the firefighter's gloves. Therefore, water and debris can enter into the firefighter's gloves through the space between the ends of the sleeves of the firefighter's coat and the firefighter's gloves. Of course, water and/or debris within the firefighter's gloves presents an objectionable condition.

It is therefore an object of this invention to provide protective means which prevent entry of water and/or debris into the gloves of a firefighter as the firefighter wears a conventional firefighter's coat and conventional firefighter's gloves.

It is another object of this invention to provide such protective means which can be readily attached to the sleeves of a firefighter's coat and which protective means are adjustable with respect to the sleeves of the firefighter's coat.

It is another object of this invention to provide such protective means which conforms to the curvature of the sleeves of the firefighter's coat.

It is another object of this invention to provide such protective means which can be constructed of firefighting protective material.

It is another object of this invention to provide such protective means which does not interfere with the firefighting activity of a firefighter who wears a firefighter's coat which includes the protective means.

It is another object of this invention to provide such protective means which can be produced at relatively low costs.

Other objects and advantages of this invention reside in the construction of the protective means, the attachment thereof, the method of production, and the mode of use, as will become more apparent from the following description.

SUMMARY OF THE INVENTION

This invention comprises protective means which are attachable to the sleeves of a firefighter's conventional coat and which protective means prevent entry of water and/or debris into conventional gloves worn by the firefighter adjacent the sleeves during firefighting activity.

The protective means comprise a shield member which is attached to the sleeve of the firefighter's coat adjacent the end portion of the sleeve. The shield member extends from the sleeve and includes moisture protective material. The shield member may also include thermal protective material. The shield member has a slight degree of rigidity but is capable of conforming to the shape of the portion of the sleeve of the firefighter's coat to which the shield member is attached.

Preferably, the shield member is removably and adjustably attached to the sleeve of the firefighter's coat. Thus, the shield member can be readily attached and detached from the sleeve. Also, the shield member can be adjusted angularly and longitudinally in its position with respect to the sleeve of the firefighter's coat.

Any suitable method of attachment of the shield member to the sleeve of the firefighter's coat may be used. For example, hook and pile attachment means may be used. Also, for example, pressure or snap types of attachment means may be used. In some situations the shield member may be permanently secured to the end portion of the sleeve of the firefighter's coat or the shield member may be an integral part of a sleeve of the firefighter's coat.

DETAILED DESCRIPTION OF THE PREFERRED EMBODIMENT

Figure 2:
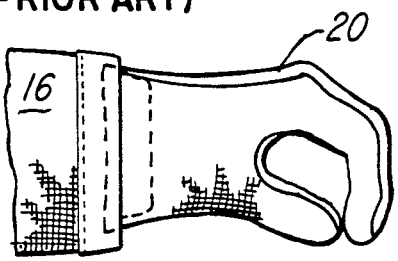
FIG-2 (PRIOR ART)
FIG. 2 is an enlarged fragmentary elevational view showing a portion of the sleeve of a conventional firefighter's coat and a firefighter's conventional glove associated therewith.
Figure 3:
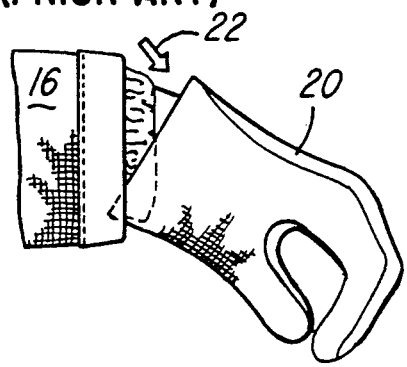
FIG-3 (PRIOR ART)
FIG. 3 is an enlarged fragmentary elevational view, similar to FIG. 2, showing the sleeve portion of the firefighter's conventional coat and the firefighter's conventional glove, and showing the space which frequently occurs between the firefighter's glove and the sleeve during firefighting activity. This view illustrates the manner by which water and/or debris enters the firefighter's glove during firefighting activity.

FIGS. 2 and 3 show a sleeve portion 16 of a firefighter's conventional coat and a firefighter's conventional glove 20 associated with the sleeve portion 16 of the firefighter's coat.

FIG. 2 shows the relationship between the sleeve 16 and the firefighter's glove 20 during a period of relative inaction of the firefighter while wearing the conventional firefighter's coat which has the sleeve portion 16 and while the firefighter wears the firefighter's glove 20. FIG. 3 illustrates an angular position of the firefighter's glove 20 with respect to the sleeve 16, which angular position frequently occurs during firefighting activity of the firefighter. As illustrated by an arrow 22 in FIG. 3, the angular relationship between the firefighter's glove 20 and the sleeve 16 permits entry of water and other material into the glove 20. Of course, entry of water and other material into the firefighter's glove 20 is objectionable.

Figure 1:
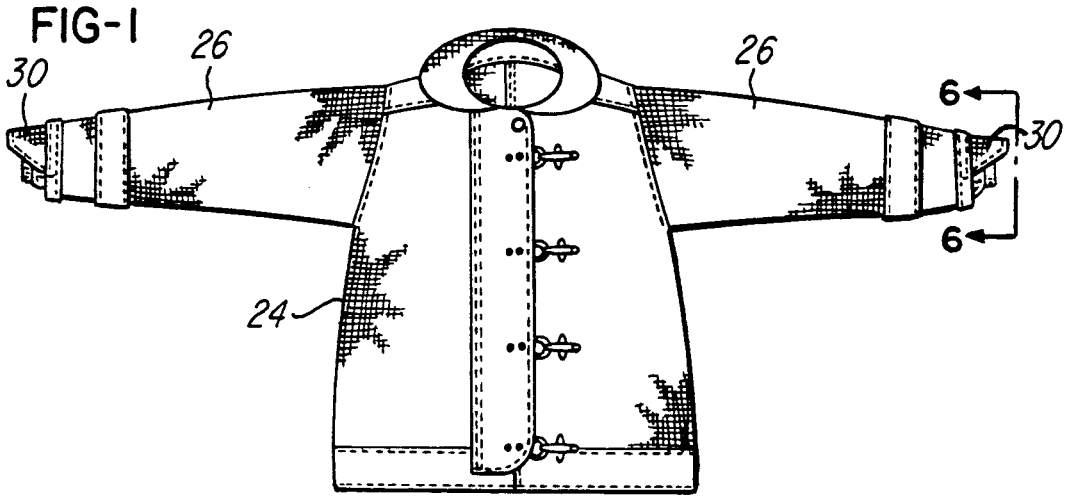
FIG. 1 is a front elevational view of a firefighter's coat which includes protective shield members of this invention.

FIG. 1 shows a firefighter's coat 24 which includes sleeves 26. A firefighter's glove 28 covers the hand and wrist of the firefighter adjacent each sleeve 26. Each of the sleeves 26 includes a protective shield 30 of this invention. The firefighter's coat 24 comprises firefighting protective material which conventionally includes flame resistant, moisture resistant and thermal protective material. The protective shield 30 comprises moisture resistant material and may also include thermal resistant material and other firefighting protective materials.

Figure 4:
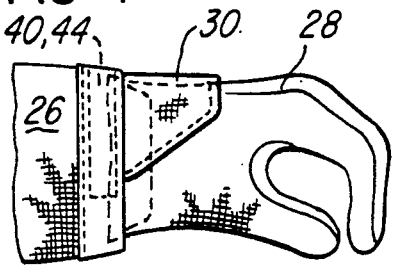
FIG. 4 is an enlarged fragmentary elevational view, similar to FIG. 2, but showing a portion of the sleeve of a firefighter's coat and showing a protective shield of this invention as the protective shield is supported by the sleeve of the firefighter's coat. This view also shows a firefighter's glove protected by the protective shield.
Figure 5:
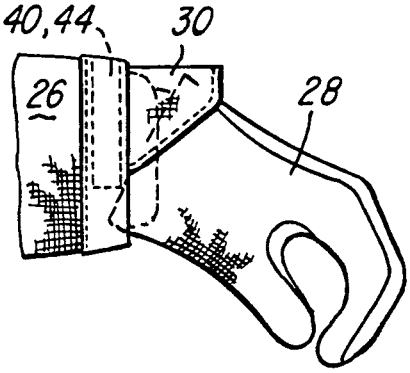
FIG. 5 is an enlarged fragmentary elevational view, similar to FIG. 3, illustrating the manner by which the protective shield of the FIGS. 1 and 4 protects against entry of water and/or debris into the firefighter's glove during angular positioning of the hand which is covered by the firefighter's glove.
Figure 6:
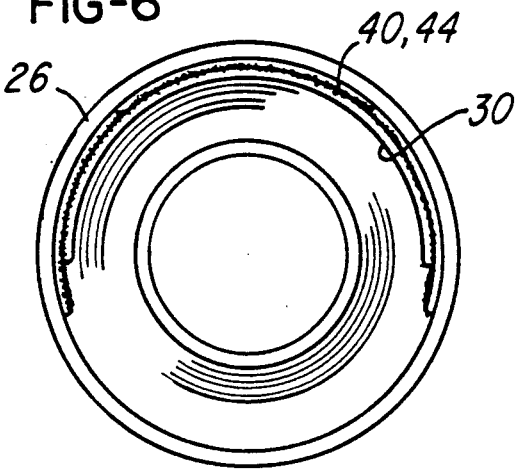
FIG. 6 is an enlarged end view taken substantially on line 6—6 of FIG. 1, showing the protective shield of FIGS. 1, 4, and 5.
Figure 7:
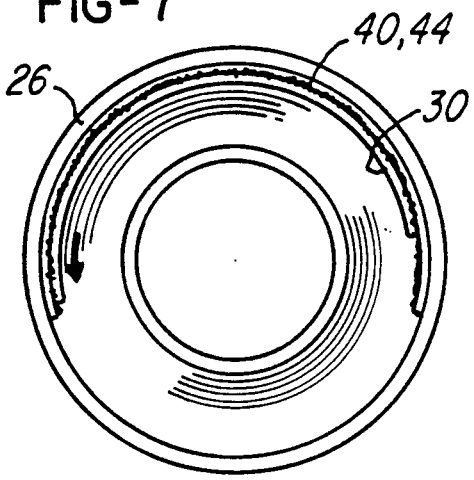
FIG. 7 is an enlarged view, similar to FIG. 6, illustrating an adjusted position of the protective shield of FIGS. 1, 4, 5, and 6.
Figure 8:
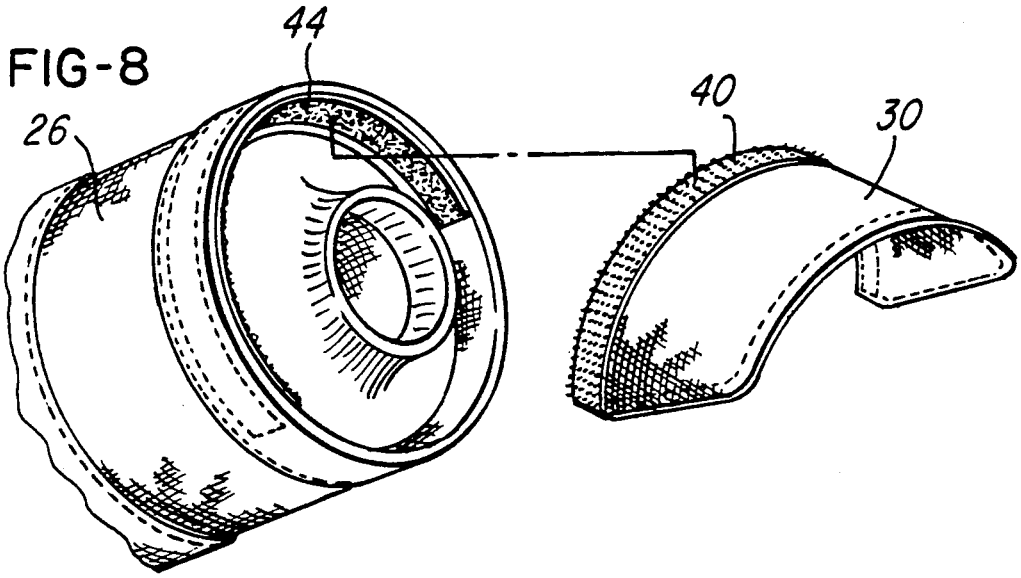
FIG. 8 is a fragmentary exploded perspective view showing a portion of the sleeve of FIGS. 1, 4, 5, 6, and 7, and illustrating a preferred structure and a preferred method by which the protective shield of this invention is attached to the sleeve of the firefighter's coat.
Figure 9:
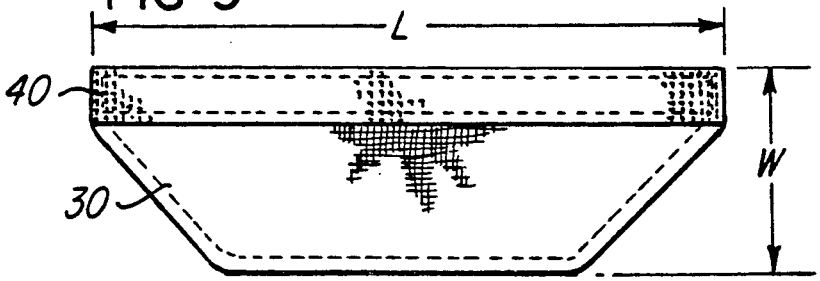
FIG. 9 is a plan view, drawn on substantially the same scale as FIG. 8, showing the protective shield of this invention.

As shown in FIG. 9, the protective shield 30 has a length L and a width W. As best shown in FIGS. 6, 7, and 8, the length L of the protective shield 30 is preferably equal to about one-half the circumference of the sleeve 26. However, the length of the shield 30 may be greater than or less than one-half the circumference of the sleeve 26. As best shown in FIGS. 4 and 5, the shield 30 is attached to the upper portion of the sleeve 26 and extends over a portion of the firefighter's glove 28. Thus, the protective shield 30 covers any space which occurs between the firefighter's sleeve 26 and the firefighter's glove 28.

When the firefighter who wears the firefighter's coat 24 is engaged in firefighting activity the firefighter's hand, covered by the glove 28, may extend directly from the sleeve 26 in a substantially straight line, as shown in FIG. 4. However, during firefighting activity, the firefighter's hand, covered by the firefighter's glove 28, may frequently extend angularly downwardly from the sleeve 26, as shown in FIG. 5. Therefore, for best protection of the firefighter's glove 28 the protective shield 30 is positioned at the upper portion of the sleeve 26. When the protective shield 30 is so positioned at the upper portion of the sleeve 26, the protective shield 30 does not interfere with downward angular movement of the firefighter's hand which is covered by the firefighter's glove 28, as illustrated in FIG. 5. Furthermore, the protective shield 30 has a degree of flexibility which permits upward angular movement of the firefighter's hand which is covered by the glove 28.

The preferred method of attachment of the shield 30 to the sleeve 26 is by means of hook and pile material. FIG. 8 shows a strip 40 of hook and pile material secured to the shield 30. This view also shows a complementary strip 44 of hook and pile material secured to the inner surface of the sleeve 26. Preferably, the strip 44 of hook and pile material extends around a portion of the sleeve 26 which is slightly greater than one-half the circumference of the sleeve 26. Preferably, the strip 40 of hook and pile material extends substantially the length L of the shield 30.

The hook and pile means of attachment of the shield 30 to the sleeve 26, which includes the hook and pile strips 40 and 44, makes possible quick attachment of the protective shield 30 to the sleeve 26. Also, the hook and pile means of attachment also makes possible adjustment of the attachment of the protective shield 30 to the sleeve 26. FIG. 6 shows the protective shield 30 attached to the sleeve 26 at the upper portion of the sleeve 26, with substantially equal portions of the protective shield 30 at each side of the center of the sleeve 26. FIG. 7 shows the protective shield 30 attached to the sleeve 26 with a greater portion of the protective shield 30 at one side of the center of the sleeve 26. Thus, the protective shield 30 can be attached to the sleeve 26 as desired by the firefighter who wears the coat 24.

If desired, instead of the hook and pile material 40 and 44, the protective shield 30 may be adjustably and removably attached to the sleeve 26 by means of snap devices or the like, or by any other suitable means.

Due to the fact that a protective shield of this invention is removable, if damage should occur to a protective shield during firefighting activity, the protective shield can be readily replaced by another protective shield.

Also, due to the fact that a protective shield of this invention is removable, if for any reason, a protective shield of a given size or shape or physical characteristics is not best for its intended use, the protective shield can be replaced by another protective shield which has different physical characteristics.

Also, if desired, a protective shield of this invention may be permanently attached to a sleeve of a firefighter's coat or a protective shield of this invention may be an integral part of the sleeve 26.

Although the preferred embodiment of the firefighter's protective shield of this invention has been described, it will be understood that within the purview of this invention various changes may be made in the form, details, proportion and arrangement of parts the combination thereof, and the mode of use, which generally stated consist in a firefighter's protective shield within the scope of the appended claims.

We claim:

1. A firefighter's coat for use by a firefighter in firefighting activity in which water is employed in the firefighting activity, the firefighter's coat being of the type constructed of firefighting protective material and including a pair of sleeves, each of the sleeves having an end portion having an upper portion, the firefighter's coat being of the type in which the firefighter who wears the firefighter's coat also wears a pair of gloves, each glove being positioned adjacent the end portion of one of the sleeves and in which a space may occur between the end portion of the sleeve and the glove during firefighting activity of the firefighter who wears the firefighter's coat, the improvement comprising a pair of protective shield members, each of the protective shield members being releasably attached only to the upper portion of the end portion of one of the sleeves and extending only from the upper portion of the end portion of the sleeve and extending over a portion of the glove which is adjacent the end portion of the sleeve, whereby a portion of each protective shield member covers a portion of the glove which is positioned adjacent the end portion of the sleeve, and whereby a portion of the protective shield member covers any space which occurs between the end portion of the sleeve and the glove, and whereby each protective shield member prevents entry of water into the respective glove as the firefighter is engaged in firefighting activity.

2. The firefighter's coat of claim 1 in which each of the protective shield members is constructed of firefighting protective material.

3. The firefighter's coat of claim 1 in which each of the protective shield members is constructed of bendable material which conforms to the curvature of the sleeve to which the protective shield member is attached.

4. The firefighter's coat of claim 1 in which each of the protective shield members has a shape which conforms generally to the curvature of the end portion of the sleeve of the firefighter's coat to which the protective shield member is attached.

5. The firefighter's coat of claim 1 in which each of the protective shield members includes hook and pile attachment material and in which the end portion of each of the sleeves includes complementary hook and pile material which is positioned only at the upper portion of the sleeve, the hook and pile material of the protective shield member being releasably attached to the hook and pile material of the respective sleeve of the firefighter's coat, the hook and pile material of the protective shield member and the hook and pile material of the respective sleeve being in the form of elongate strips of material, the protective shield member having a given width dimension, the elongate strip of hook and pile material which is positioned at the upper portion of the sleeve having a length dimension greater than the width dimension of the shield member, whereby the protective shield member is adjustably angularly attached to the respective sleeve.

6. The method of protection of a firefighter's glove against entry of water thereinto when the firefighter's glove is positioned upon a firefighter's hand which is adjacent the sleeve of a firefighter's coat which is worn by the firefighter during firefighting activity in which water is involved, the sleeve having an end portion, the end portion having an upper portion, the firefighter's coat being constructed of firefighting protective material and in which a space may exist between the end portion of the sleeve and the glove during firefighting activity, comprising providing a planar shield member, forming the shield member into a curved condition, attaching the shield member in a curved condition only to the upper portion of the end portion of the sleeve of the firefighter's coat, with the shield member extending only from the upper portion of the sleeve of the firefighter's coat and over a portion of the firefighter's glove which is adjacent the end portions of the sleeve, whereby entry of water into the firefighter's glove between the end portion of the sleeve and the firefighter's glove is prevented.

7. The method of claim 6 which includes releasably attaching the shield member to the upper portion of the end portion of the sleeve of the firefighter's coat.

8. The method of claim 7 in which the shield member comprises a body of firefighting protective material.

* * * * *